US008337157B2

(12) United States Patent
Kilian et al.

(10) Patent No.: US 8,337,157 B2
(45) Date of Patent: Dec. 25, 2012

(54) BLOWER WHEEL

(75) Inventors: Jörg Kilian, Renningen (DE); Peter Lucyga, Gerlingen (DE); Nikolaus Zipf, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 1125 days.

(21) Appl. No.: 11/994,745

(22) PCT Filed: Jul. 4, 2006

(86) PCT No.: PCT/EP2006/006513

§ 371 (c)(1),
(2), (4) Date: Sep. 22, 2008

(87) PCT Pub. No.: WO2007/003416

PCT Pub. Date: Jan. 11, 2007

(65) Prior Publication Data

US 2009/0129933 A1 May 21, 2009

(30) Foreign Application Priority Data

Jul. 4, 2005 (DE) ..... 10 2005 031 471

(51) Int. Cl.
*F01D 5/18* (2006.01)

(52) U.S. Cl. ..... 416/97 R; 416/91; 416/96 R; 416/248; 416/500; 415/115; 415/257; 415/203; 361/695

(58) Field of Classification Search ..... 415/115, 415/157, 201–203; 416/91, 96 A, 215, 248, 416/241 R, 500, 97 R; 361/695
See application file for complete search history.

(56) References Cited

U.S. PATENT DOCUMENTS

| | | | | |
|---|---|---|---|---|
| 2,418,012 | A | 3/1947 | Chester | |
| 4,604,031 | A * | 8/1986 | Moss et al. | 416/97 R |
| 5,988,979 | A | 11/1999 | Wang | |
| 6,033,186 | A | 3/2000 | Schilling et al. | |
| 6,835,051 | B2 | 12/2004 | Heim et al. | |

FOREIGN PATENT DOCUMENTS

| | | | |
|---|---|---|---|
| DE | 17 53 723 | U1 | 10/1957 |
| DE | 21 13 189 | A | 9/1972 |
| DE | 27 54 582 | A1 | 6/1979 |
| DE | 197 07 571 | A1 | 8/1998 |
| EP | 1 256 722 | A2 | 11/2002 |
| EP | 1 384 894 | A2 | 1/2004 |
| GB | 3525 | A | 0/1912 |
| GB | 191203525 | | 0/1912 |
| GB | 317798 | A | 1/1930 |

(Continued)

OTHER PUBLICATIONS

Office Action mailed Aug. 2, 2011 in related Japanese Application No. 2008-518759 (5 pgs.).

(Continued)

*Primary Examiner* — Dung A. Le
(74) *Attorney, Agent, or Firm* — Foley & Lardner LLP

(57) ABSTRACT

The invention relates to a blower wheel, especially a plastic blower wheel for a cylindrical rotor radial fan for the heating and air-conditioning systems of a motor vehicle. Said blower wheel comprises a plurality of blades (2), and the flow channel (3) between two blades (2) is embodied in such a way that it is convergent on the inflow side, divergent on the outflow side, and distinctively shaped.

14 Claims, 11 Drawing Sheets

FOREIGN PATENT DOCUMENTS

Figure 1:
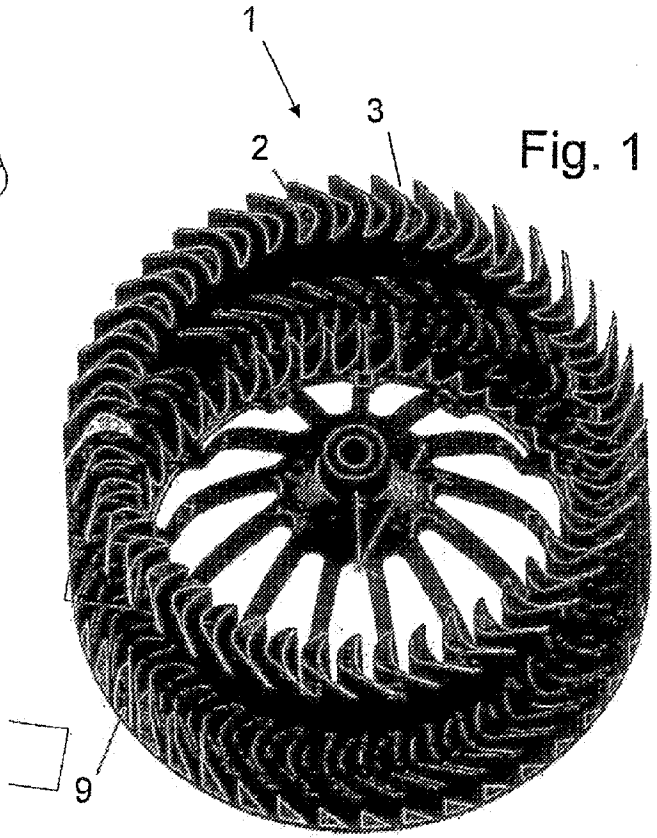

| | | | |
|---|---|---|---|
| GB | 720956 | A | 12/1954 |
| GB | 1 359 111 | | 7/1974 |
| GB | 1 548 471 | | 7/1979 |
| JP | 48003134 | | 1/1973 |
| JP | 51015204 | | 2/1976 |
| JP | 60-156997 | A | 8/1985 |
| JP | 61258999 | A | 11/1986 |
| JP | 62020197 | | 2/1987 |
| JP | 2173398 | A | 7/1990 |
| JP | 2002285996 | A | 10/2002 |
| JP | 2004060447 | A | 2/2004 |
| JP | 2005-155579 | A | 6/2005 |

OTHER PUBLICATIONS

Office Action mailed Jun. 19, 2012 in related Japanese Application No. 2008-518759 (5 pgs.).

* cited by examiner

BLOWER WHEEL

The invention relates to a blower wheel, in particular a plastic blower wheel for a drum rotor radial fan for the heating and air-conditioning of a motor vehicle.

Drum rotor radial fans which are used for feeding air in motor vehicle heaters or motor vehicle air-conditioning systems should often be operated at as low a rotational speed as possible. Here, the inflow conditions to a subsequent heat exchanger should be as favorable as possible, wherein the available installation space, which is generally very restricted, should be utilized as flexibly as possible. On account of the boundary conditions, axially widened spiral housings and blower wheels with static pressure generation in the blade duct are generally used here. Here, the blade arrangements are curved backward, so as to end radially or curved slightly forward and without or with slight profiling. The flow in the blade duct is detached here and remains detached until the blade duct end. On account of said type of blade arrangement, very high to high rotational speeds are necessary depending on the operating point and type of blade arrangement. For acoustic reasons, backward-curved blade arrangements are generally not used in motor vehicle heaters or motor vehicle air-conditioning systems.

Radial fans, which permit a low rotational speed, have a forward-curved blade arrangement and reach comparable operating points at considerably lower rotational speeds. In the forward-curved blade arrangement, the flow is deflected and accelerated intensely. Said kinetic energy is decelerated in ideally-designed, parallel-walled spiral housings and is converted into static pressure. Flow detachment occurs at the blade duct inlet, and the flow attaches again at the blade duct end. Axially widened spiral housings which are favorable for the heat exchanger loading and are of radially narrower construction are generally not expedient in the case of said fans with forward-curved blades, since efficiency losses occur.

In order to be able to operate a drum rotor radial fan which is used for feeding air for example in motor vehicle heaters or motor vehicle air-conditioning systems even at the lowest possible rotational speeds, drum rotor radial fans are known which have a forward-curved blade arrangement. Here, the blade arrangement is not profiled or is only slightly profiled. The blades are usually solidly molded (cf. left part of FIG. 5, which illustrates the flow profile in a blade duct in a conventional, unprofiled blower wheel, with a vortex formation being visible on the suction side of the blades).

EP 1384894 A2 discloses a blade design in which it is attempted to obtain a detachment-free blade duct throughflow by means of a second blade row which forms a gap between the blade pressure and suction sides. Here, there is a resulting loss-afflicted exchange of energy between the blade pressure and suction sides, and resulting gap losses.

It is therefore an object of the invention to provide an improved blower wheel in which the fewest possible detachments occur in the blade duct.

Said object is achieved by means of a blower wheel having the features of claim 1. Advantageous embodiments are the subject matter of the subclaims.

According to the invention, a blower wheel is provided, in particular a plastic blower wheel for a drum rotor radial fan for the heating and air-conditioning of a motor vehicle, which blower wheel has a plurality of blades, with the flow duct between two blades preferably being designed so as to be convergent at the inflow side, divergent at the outflow side and intensely profiled. The convergent-divergent design of the blower wheel in connection with the intense profiling permits substantially detachment-free operation in the blade duct.

Here, as a result of the intense arching and sufficient thickness of the blade region in the convergent region, the flow in the corresponding duct part is accelerated and deflected without separation in the rotational direction of the blower wheel. In the subsequent, virtually straight, divergent duct part, the flow is decelerated substantially without separation, with the static pressure being increased. By means of a corresponding embodiment, in particular of a single-part blade design, there is no loss-afflicted exchange of energy between the blade pressure and suction sides.

In the case of a design of the flow duct which is convergent at the inflow side and divergent at the outflow side, the blade duct length ratio is preferably between 0.1 and 0.9, in particular between 0.15 and 0.7, particularly preferably between 0.2 and 0.6. Here, the duct narrowing in the convergent part of the blade duct is preferably between 0.030 and 0.20, in particular between 0.04 and 0.07, particularly preferably between 0.05 and 0.06. The duct widening in the divergent part of the blade duct is preferably between 0.05 and 0.17, in particular between 0.09 and 0.15, particularly preferably between 0.1 and 0.14.

The blades of the blower wheel are preferably of intensely profiled design. Blades in which the ratio of profile thickness to profile overall length is greater than 0.15, in particular greater than 0.2, are considered to be intensely profiled. Here, the pressure-side inlet angle is preferably between 30° and 90°, particularly preferably between 35° and 80°, and the suction-side inlet angle between 25° and 70°, particularly preferably between 30° and 60°, the pressure-side outlet angle between 90° and 175°, particularly preferably between 100° and 165°, and the suction-side outlet angle between 90° and 170°, particularly preferably between 100° and 165°, particularly preferably in each case in a mean range, that is to say in particular +/−10° around the mean value of the respectively previously specified ranges, in order to obtain an optimum flow profile without detachments and an optimum efficiency and low-noise operation.

The blades are preferably formed by a supporting, preferably solid structure onto which a soft component is molded at least in regions or into which a soft component is injected at least in regions. Here, the supporting structure is preferably a first plastic which has a sufficient strength, and the soft component is preferably a second plastic which is softer. The second plastic is preferably a foamed plastic. Said embodiment permits substantially warp-free and shrinkage-free production of the blower wheel.

The maximum wall thickness of the supporting structure in the region of the blades is preferably 3 mm. With such a restriction of the wall thickness, it is reliably possible to avoid warping and shrinkage, though it is possible by means of a corresponding material selection of the material which forms the structure to ensure a sufficient strength of the blower wheel. In addition, it is possible by means of a corresponding material selection of the soft component to reduce the weight of the blower wheel, so that the fan is lighter overall. In addition, the soft component has an acoustically absorbing effect, so that the fan is slightly quieter than corresponding fans without a soft component.

The soft component preferably forms the profile of the blades at least in regions, in particular in the intensely profiled part. A soft component layer is particularly preferably provided both on the suction side and on the pressure side, and the ends of the blades are preferably free from the soft component, as a result of which the soft component is additionally protected from damage during assembly.

According to one weight-saving embodiment, the blades are preferably formed at least in regions as a hollow profile.

Here, in order to increase the stiffness, webs can be formed in the hollow profile. Said webs are preferably closed off at one side. In the case of a frame-side closure of the hollow profile, the blades are preferably conically narrowed at the frame side.

The blades are preferably of cylindrical design at the blower wheel hub side on the motor side and of conical design at the frame side, with said blades narrowing in the frame direction. This ensures that, despite the intense profiling in connection with the overlap by the frame, a sufficient intake cross section is available, and blocking of the intake cross section does not occur.

The production of a blower wheel of said type takes place preferably by means of plastic injection molding, with a supporting structure composed of a first plastic preferably being molded first, and at least a part of the profiled blades of the blower wheel and/or of a hollow profile subsequently or virtually simultaneously being molded by means of a second, softer plastic which is molded onto the supporting structure or into a hollow profile formed by the supporting structure.

Consideration is given in particular to PA or PP or else metals as materials for the supporting structure. The soft component which surrounds the supporting structure at least in regions is preferably considered by a foamed plastic, such as in particular S-EPS. Likewise highly suitable is PP-EPDM. It is generally possible for PUR foam, melamine foam, PE foam (use of propellant in the application), silicone foam or, with restrictions, also foamed elastomers.

Said materials for the supporting structure can correspondingly also be used for blower wheels without a soft component, with it being possible for in particular foamed materials to be used in this case.

Figure 2:
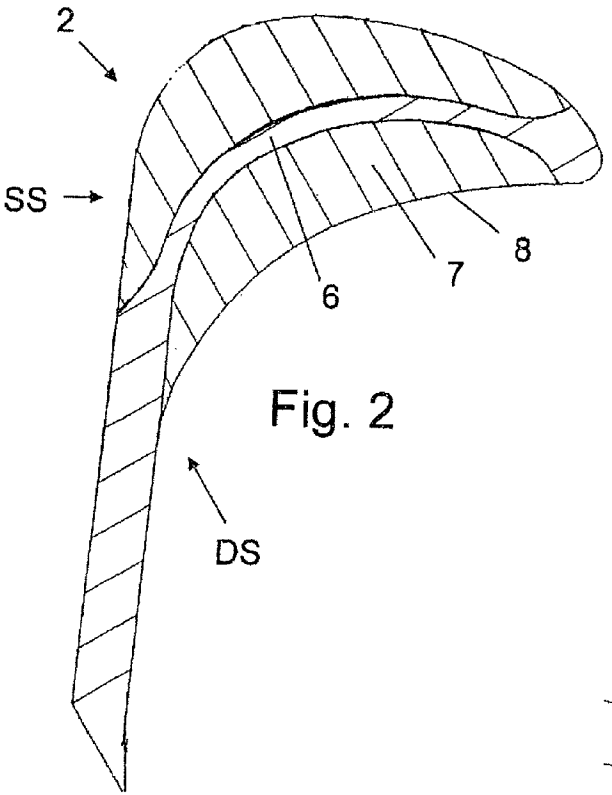
Figure 3B:
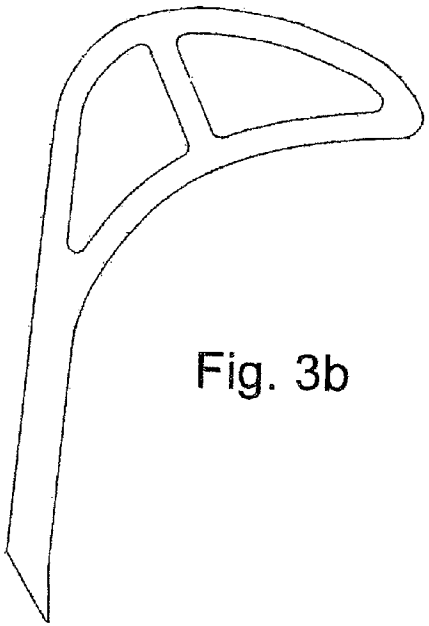
Figure 3A:
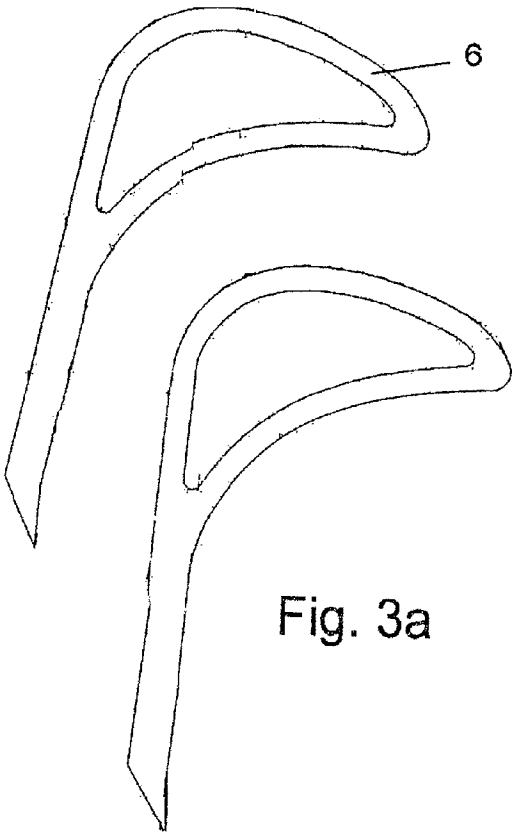
Figure 4:
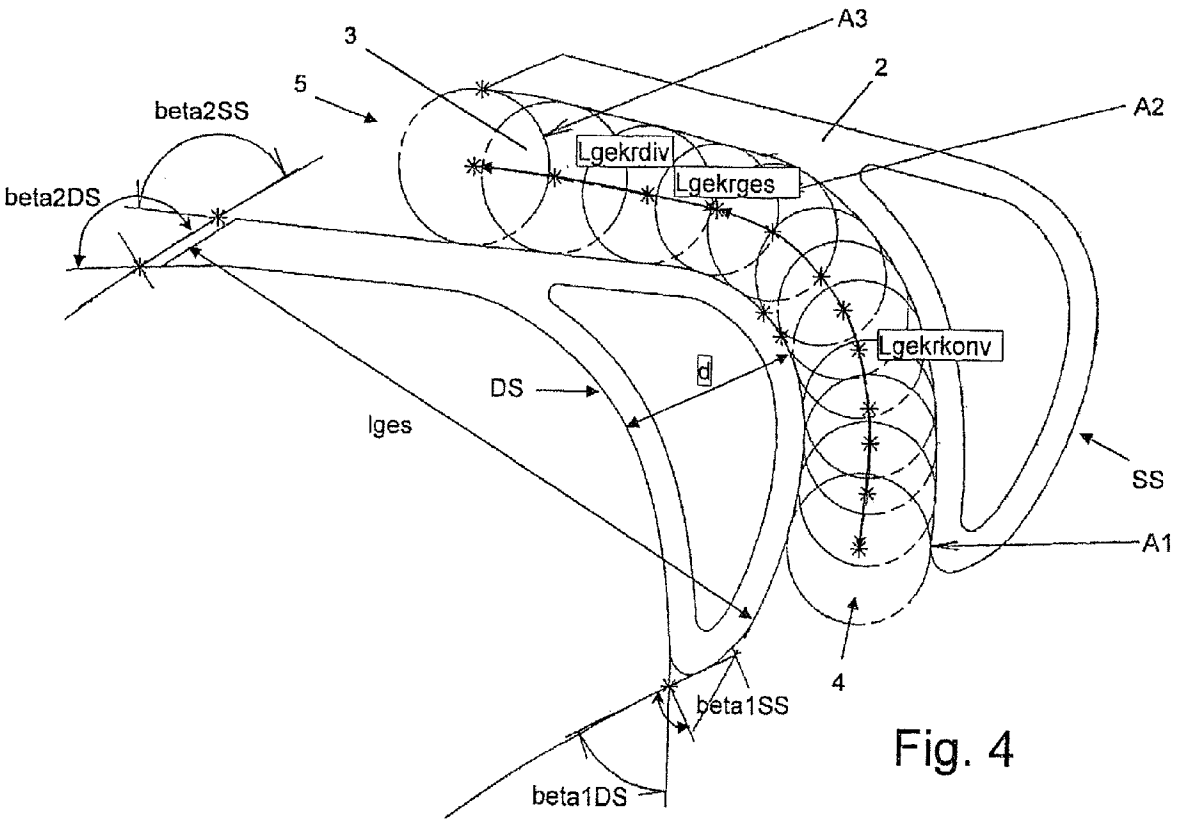
Figure 5:
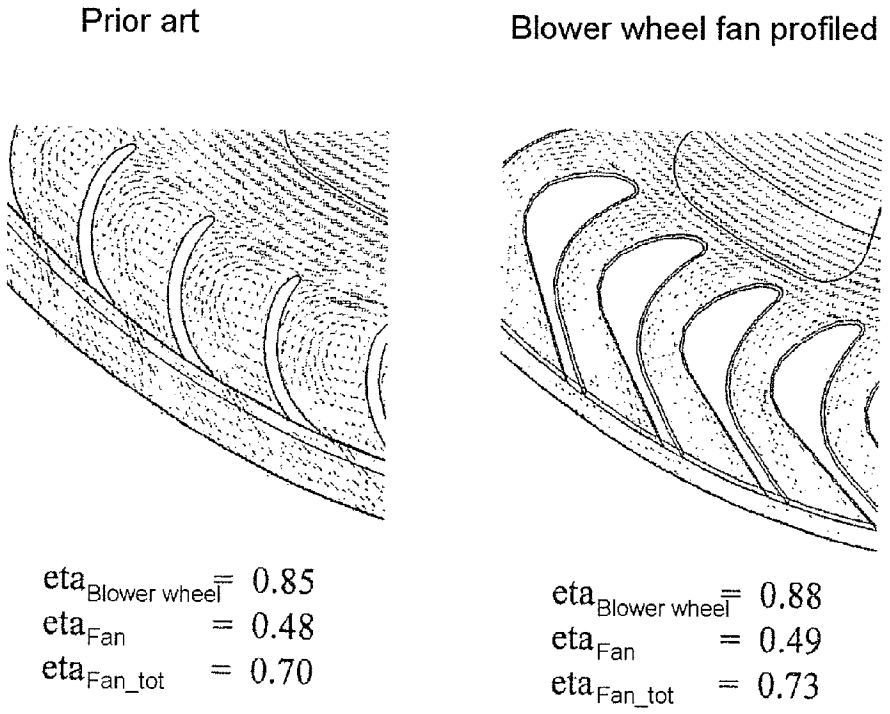
Figure 6:
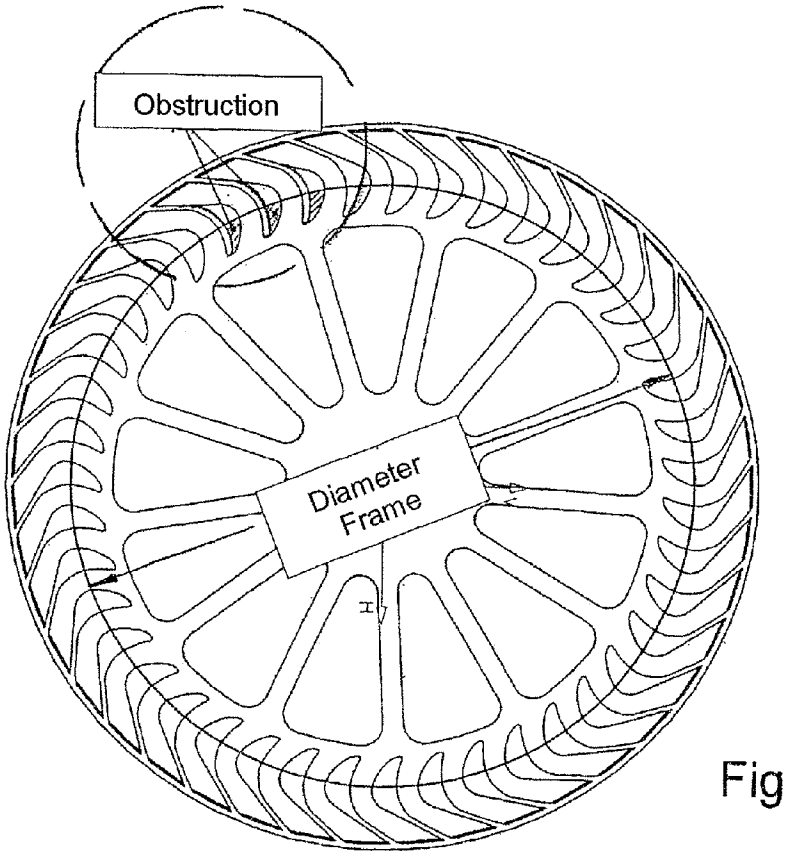
Figure 7:
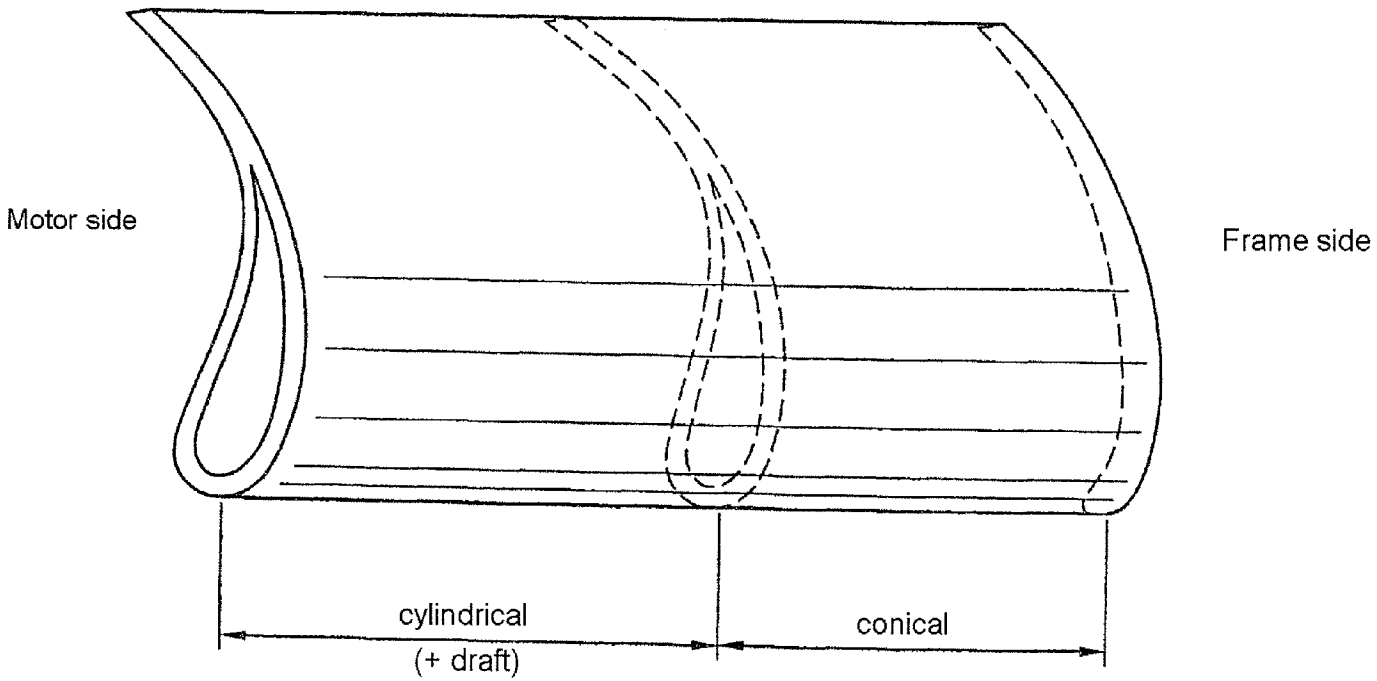
Figures 8, 9:
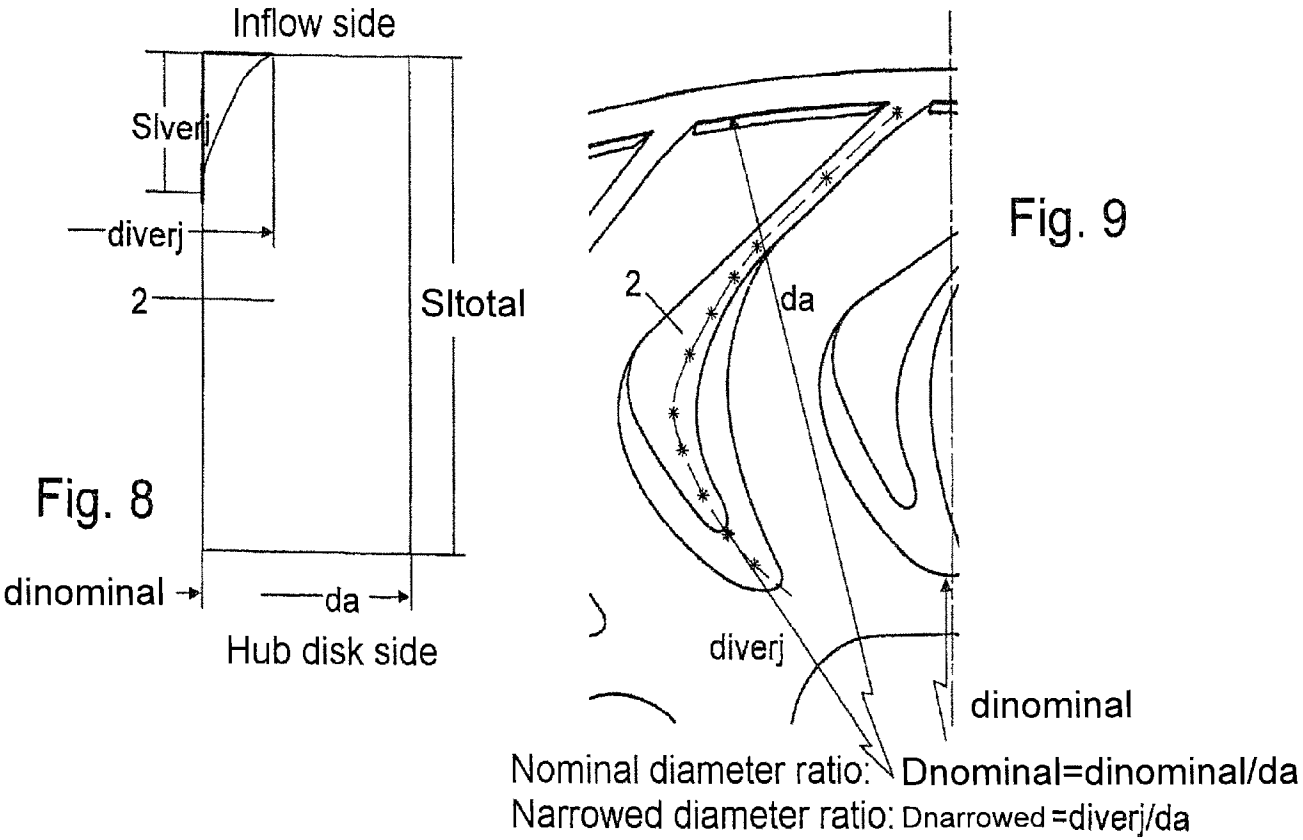
Figure 10:
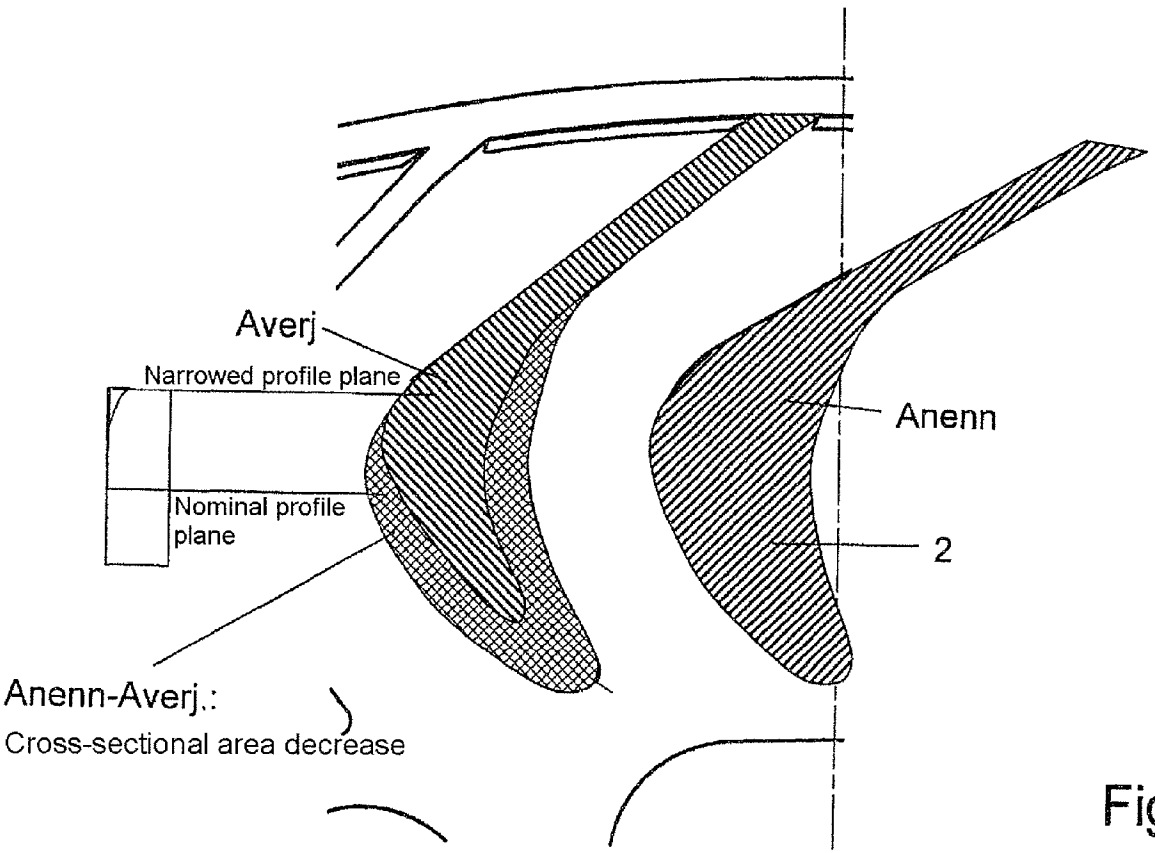
Figures 11A, 11B, 11C, 11D:
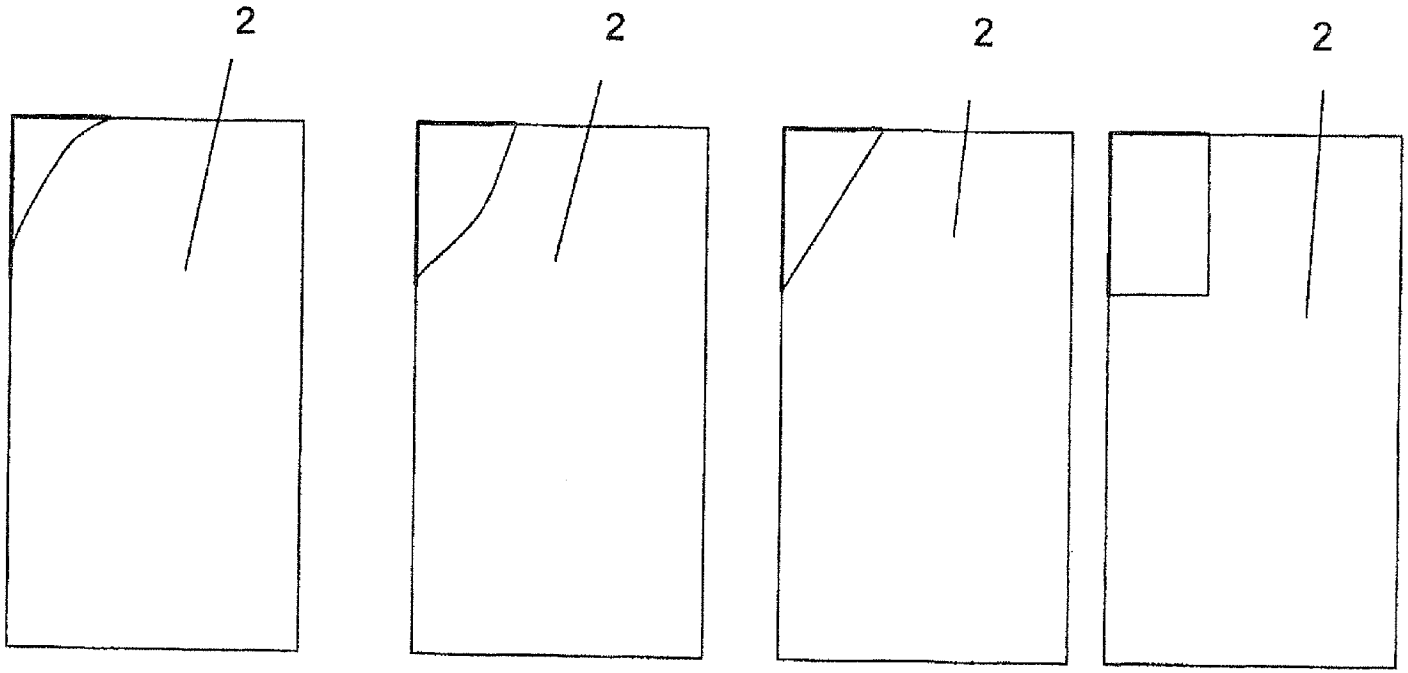
Figure 13:
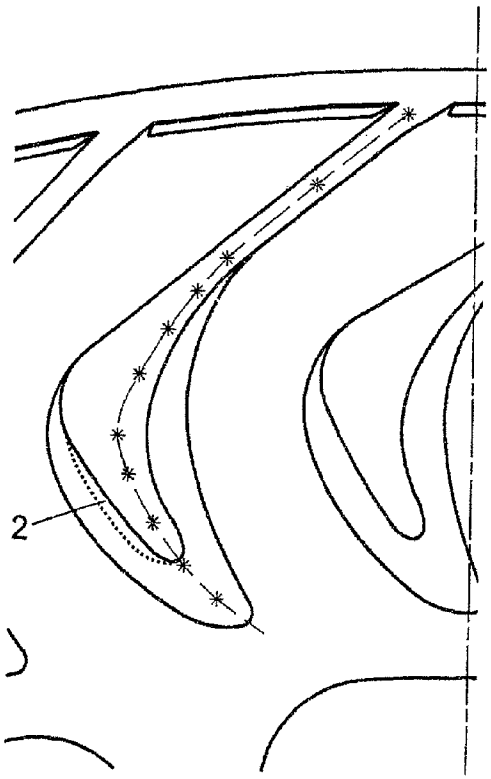
Figure 12:
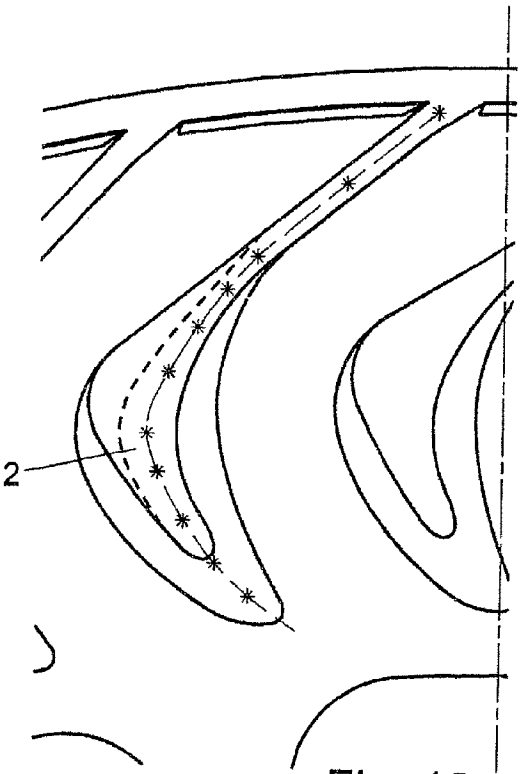
Figure 14:
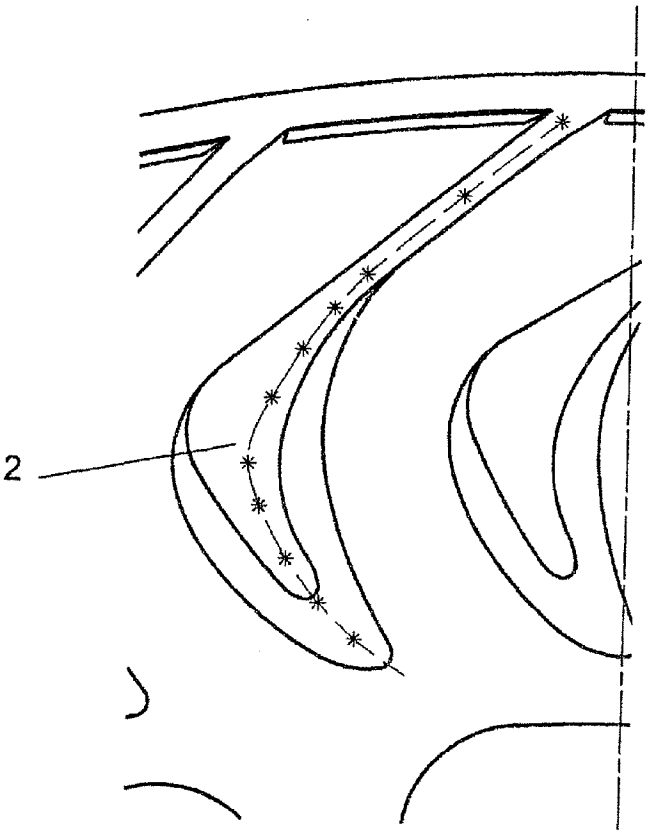

The invention is explained in detail below on the basis of an exemplary embodiment with a plurality of variants and with reference to the drawing, in which:

FIG. 1 shows a perspective view of a blower wheel according to the invention as per the exemplary embodiment, FIG. 2 shows a section through a blade of the blower wheel from FIG. 1, FIGS. 3*a*, 3*b* show sections through blade variants, FIG. 4 shows a detail view of a section through a blade in order to clarify individual dimensions, FIG. 5 shows a section through a conventional, solid blower wheel with flow speeds illustrated by arrows in the left part of FIG. 5, and a section through a forward-curved profiled blower wheel as per the present invention in the right part of FIG. 5, FIG. 6 shows a plan view of a blower wheel, FIG. 7 is a schematic illustration of a further blade variant with an illustration of the cross sections of three section planes, FIG. 8 shows a schematically illustrated section in the longitudinal direction through a blade in order to clarify the blade narrowing, FIG. 9 shows a detail section transversely through a blower wheel with narrowed blades, FIG. 10 shows a section corresponding to FIG. 9 in order to clarify the reduction in the blade cross-sectional area, FIGS. 11*a*-11*d* are schematic illustrations of possible profiles of blade narrowings, FIG. 12 is a schematic illustration of a symmetrical narrowing relative to the base profile median line of the blade, FIG. 13 is a schematic illustration of an asymmetrical narrowing relative to the base profile median line of the blade, and FIG. 14 is a schematic illustration of a symmetrical-asymmetrical narrowing relative to the base profile median line of the blade.

A drum rotor radial fan which is used for feeding air in a motor vehicle air-conditioning system generally has a blower wheel 1 with a ring of blades 2, with a blade duct 3 being formed between in each case two blades 2. The blower wheel 1 is attached in a known way to a fan motor shaft (not illustrated). At the suction side, the blower wheel 1 is partially covered by the frame which is part of the spiral housing. The frame opening for the air intake is indicated in FIG. 6.

The blades 2 are of intensely profiled design, with the flow duct 3 being designed so as to be convergent in the inlet region 4 and divergent in the outlet region 5 (cf. FIG. 4). The pressure side DS of the blades 2 is of concave design in the inlet region 4, if appropriate up to the outlet region 5, and the suction side SS of the blades 2 is of convex design in the inlet region 4 and of straight design in the outlet region 5, with the blade thickness d having its maximum in the convergent region.

In order to avoid problems in the production of intensely profiled blades, the blades 2 are in the present case composed of a structure 6, which in the present case is solidly formed from a plastic and has a sufficient strength for the loads to be expected, and a layer 7 formed from a soft component which is molded onto the structure 6, which soft component forms the profile in the intensely profiled region of the blades 2. Here, the thickness of the structure 6 is a maximum of 3 mm, so that no problems with regard to warping or shrinkage occur during the production of the structure 6. In addition, said thickness is generally sufficient for a sufficient stiffness of the blades 2. The molded-on layer 7 serves merely for profiling and has no supporting function—aside from the requirement of not being compressed by the air which is to be fed. Here, the molded-on layer 7 also has a skin or coating on its outer side 8, wherein the coating, in particular for preventing contamination, can if appropriate also cover all of the blades 2 or the entire blower wheel 1 in order to simplify production.

The supporting structure 6 is formed, in the region of the blade 2 which is covered by the soft component, so as to be slightly narrowed, with the narrowing taking place gradually. The outer contour is not adversely affected by the transition from supporting structure 6 to soft component.

The supporting structure 6 is, according to the present exemplary embodiment, composed of PA, and the soft component is composed of PP-EPDM.

FIGS. 3*a* and 3*b* illustrate variants of the blade 2, wherein in the present case, in said blades, the structure 6 itself forms the profile, for which purpose said structure 6 is embodied as a hollow profile, in the case of the second variant with a stiffening web. In the interior of the hollow profile, it is possible—in particular for stiffness reasons—to provide a soft component corresponding to the molded-on layer 7. It is likewise possible in individual regions to provide an externally molded-on layer corresponding to the above-described exemplary embodiment. In this case, too, the thickness of the structure is a maximum of 3 mm, so that no warping or shrinkage occurs during production.

By means of the position of the supporting structure 6 within the profile, it is possible to set the thickness of the soft component on the blade suction side and pressure side in such a way that, in fan operation, only a minimal deformation, which does not influence the throughflow, of the soft component, in particular on the blade pressure side, occurs.

In addition, in the case of such a profiled blade design profiled as can be clearly seen in the right part of FIG. 5, no turbulence formation takes place at the suction side of the blade 2, so that the flow is well attached. This leads, in CFD calculations, to an improvement in the efficiency eta and, in acoustic measurements, to a lower noise level (cf. chart in FIG. 5, with in each case the flow profile and the corresponding efficiency at the optimum operating point of the corresponding fan being illustrated).

The following geometries are particularly suitable in a convergent-divergent blade duct in particular in the case of intensely profiled blades, that is to say for d/lges greater than 0.15, in particular greater than 0.2, with d denoting the profile thickness and lges denoting the profile overall length (measured in a straight line):

The blade duct length ratio Lkv is preferably between 0.1 and 0.9. Here, Lgekrges denotes the length of the entire curved blade duct, Lgekrdiv denotes the length of the divergent part of the curved blade duct, and Lgekrkonv denotes the length of the convergent part of the curved blade duct, where $$Lgekrges=Lgekrdiv+Lgekrkonv$$

and $$Lkv=Lgekrdiv/Lgekrges$$

The duct narrowing Kverkonv in the convergent part of the blade duct, which is given by $$Kverkonv=(A1-A2)/Lgekrkonv,$$

is preferably between 0.030 and 0.200. Here, A1 is the flow duct width at the inlet and A2 the flow duct width at the narrowest cross section.

The duct widening Kerwdiv in the divergent part of the blade duct, which is given by $$Kerwdiv=(A3-A2)/Lgekrdiv,$$

is preferably between 0.05 and 0.17. Here, A3 is the flow duct width at the outlet.

Here, the pressure-side inlet angle beta1DS is between 30° and 90° and the suction-side inlet angle beta1SS is between 25° and 70°. The pressure-side outlet angle beta2DS is between 90° and 175° and the suction-side outlet angle beta2SS is between 90° and 170°.

The above-specified angle ranges for beta1DS, beta1SS, beta2DS and beta2SS are also particularly suitable in the case of a divergent-convergent blade duct shape and a convergent blade duct shape.

As a result of an intensely profiled design of the blades 2 in connection with the inlet opening (only approximately ⅓ of the blade arrangement is not covered by the frame), obstructions can occur in the inlet region at high mass flow rates, as indicated in FIG. 6. Said obstructions can lead to a reduction in the efficiency and/or to acoustic disadvantages. For this reason, the blades 2 are, according to a further variant, formed over their length or at least one or more parts of their length parallel to the rotational axis, with a different cross section. Here, the cross section at the inlet side is, as illustrated in FIG. 7, of cylindrical design at the blower wheel hub side (the blower wheel hub side is provided with the reference symbol 9 in FIG. 1) with a draft, and designed at the frame side so as to narrow conically in the longitudinal direction toward the frame.

According to a variant not illustrated in the drawing, the blades have a solid cross section and are produced from a single material, for example a light metal or a plastic which can also be foamed, that is to say the soft component is dispensed with and is replaced by the support material.

FIGS. 8 to 10 show a further variant with respect to FIG. 6, with blades 2 which narrow in the direction of the inflow side. Here, the blades have a constant cross section over a large part of the blade length as viewed in the direction of the rotational axis. Only in the final quarter is the cross section of the blades reduced, specifically both in the longitudinal profile direction, with the inner diameter dinominal increasing up to a narrowed inner diameter diverj, the outer diameter however remaining constant, and also in the thickness direction. For better clarification of the profile variation, in FIG. 9, the median line of the base profile is denoted by a star-dash line. The profile of the narrowing over the entire blade length is illustrated in FIG. 8. The overall blade length is denoted here by Sltotal; that part of the blade length in which the inner diameter is enlarged is denoted by Slverj. The inner diameter diverj increases here, as can be seen in FIG. 8, in the final quarter of the blade length. The illustration of FIG. 8 with regard to the profile length is not to scale.

In general, ratios of blade length narrowed to overall blade length (Slver/Sltotal) of 0.1 to 0.7, preferably from 0.15 to 0.5 and particularly preferably from 0.2 to 0.25 are particularly suitable.

The diameter ratio which is given by the following equation $$DV=(Dnominal-Dnarrowed)/Dnominal$$

is generally 0.01 to 0.2, preferably 0.02 to 0.1 and particularly preferably 0.04 to 0.07, with Dnominal and Dnarrowed being given by $$Dnominal=dinominal/da$$

and $$Dnarrowed=diverj/da.$$

Here, da is the blade outer diameter, dinominal is the nominal inner diameter of the blades and diverj is the narrowed inner diameter of the blades.

In addition to the blade profile length, the thickness of the blade profile is also reduced, so that the cross-sectional area of the blade profile is also reduced in the narrowed region. The relative cross-sectional area decrease is given by $$AV=(Anenn-Averj)/Anenn,$$

where Anenn is the cross-sectional area in the non-narrowed region and is also referred to below as the base profile, and Averj is the cross-sectional area in the (most) narrowed region. The variation of the blade profile can be seen particularly clearly from FIG. 10. In general, that is to say not explicitly with respect to the present variant, the relative cross-sectional area decrease AV is in the range from 0.1 to 0.90, in particular from 0.2 to 0.8 and particularly preferably from 0.3 to 0.7.

Further variants with regard to the profile of the narrowing are illustrated by way of example in FIGS. 11*a* to 11*d*, with FIG. 11*a* showing a convex narrowing profile, FIG. 11*b* showing a concave narrowing profile, FIG. 11*c* showing a linear narrowing profile, and FIG. 11*d* showing a single-stepped narrowing profile. Any desired combinations, such as also if appropriate a multi-stepped narrowing profile, are possible.

FIGS. 12 to 14 show variants with regard to the shape of the narrowing of the blade profile in the direction of the inflow side. The profile of the narrowing can for example take place corresponding to the illustration of FIGS. 11*a* to 11*d*. For better clarification of the profile variation, in FIGS. 12 to 14, the median line of the respective base profile is denoted by a star-dash line.

The narrowing relative to the base profile can take place symmetrically with respect to the median line, as illustrated in FIG. 12 by the dashed line in a blade 2 on the suction side. The narrowing relative to the base profile can also take place asymmetrically with respect to the median line, as illustrated in FIG. 13 in a blade 2 by the dotted line on the suction side. The narrowing can likewise take place symmetrically in regions and asymmetrically in regions, as illustrated in FIGS. 12 to 14 with solid lines and as can be seen by comparing the solid lines with respect to the dashed or dotted line.

In general, it is to be noted that the duct shape in the narrowed part of the blade arrangement can be of both convergent and also convergent-divergent or divergent design.

The inlet and outlet angles in the narrowing blade part preferably deviate from those in the region of the base profile, that is to say in the part with a constant cross section, resulting in aerodynamic twisting of the blade profile. The angles can however also remain constant or at least substantially constant.

According to a variant not illustrated in the drawing, an at least partial cover disk can also be provided on the frame side.

According to a further variant which is likewise not illustrated in the drawing, the blades are formed by hollow profiles which are produced from a single material. Here, for stiffening of the profile, it is also possible for transverse struts to be provided, so that in particular also a plurality of separate cavities can be formed.

If the blades are formed as (partial) hollow profiles, then these can be designed to be open or also closed at the frame side.

The invention claimed is:

1. A plastic blower wheel for a drum rotor radial fan for a heating and air-conditioning of a motor vehicle, having a plurality of blades, wherein a flow duct between two blades is designed so as to be convergent at an inflow side, divergent at an outflow side and intensely profiled, wherein a soft component is molded at least in regions on a supporting structure of the blade, or into which blade a soft component is injected at least in regions.

2. The blower wheel as claimed in claim 1, wherein a ratio of profile thickness to profile overall length of the blade is greater than 0.2.

3. The blower wheel as claimed in claim 1, wherein a duct narrowing in the convergent part of the blade duct is between 0.030 and 0.20.

4. The blower wheel as claimed in claim 1, wherein a duct widening in the divergent part of the blade duct is between 0.05 and 0.17.

5. The blower wheel as claimed in claim 1, wherein a blade duct length ratio is between 0.2 and 0.6.

6. The blower wheel as claimed in claim 1, wherein the blades are profiled such that a pressure-side inlet angle is between 30° and 90° and a suction-side inlet angle is between 25° and 70°, a pressure-side outlet angle is between 90° and 175° and a suction-side outlet angle is between 90° and 170°.

7. The blower wheel as claimed in claim 1, wherein the blades are formed at least in regions as a hollow profile.

8. The blower wheel as claimed in claim 1, wherein a maximum solid wall thickness of the supporting structure in the region of the blades is 3 mm.

9. The blower wheel as claimed in claim 1, wherein the soft component forms the profile of the blades at least in regions.

10. The blower wheel as claimed in claim 1, wherein the blades are of hollow design, with webs being provided in the hollow blades.

11. The blower wheel as claimed in claim 10, wherein the blades which are formed as a hollow profile are closed off at one side.

12. The blower wheel as claimed in claim 10, wherein the soft component is injected into an interior of the hollow profile.

13. The blower wheel as claimed in claim 1, wherein the blower wheel is produced by two-component plastic injection molding.

14. The blower wheel as claimed in claim 1, wherein the blades are of cylindrical design at a blower wheel hub side and of conical design at a frame side.

* * * * *